United States Patent [19]

Starck

[11] 4,316,063

[45] Feb. 16, 1982

[54] SWITCH OPERATING DEVICE

[75] Inventor: Christian Starck, Angouleme, France

[73] Assignee: La Telemecanique Electrique, France

[21] Appl. No.: 141,089

[22] Filed: Apr. 17, 1980

[30] Foreign Application Priority Data

Apr. 18, 1979 [FR] France ..... 79 10573

[51] Int. Cl.[3] ..... H01H 15/00

[52] U.S. Cl. ..... 200/16 C; 200/18; 200/47; 200/76

[58] Field of Search ..... 200/17 R, 17 A, 17 B, 200/18, 153 L, 153 LA, 153 LB, 76, 163, 16 R, 16 A, 16 B, 16 C, 16 D, 47

[56] References Cited

U.S. PATENT DOCUMENTS 3,087,029 4/1963 Kniel et al. ..... 200/47

3,258,549 6/1966 Stoi ..... 200/17 R X

*Primary Examiner*—J. V. Truhe

*Assistant Examiner*—Morris Ginsburg

*Attorney, Agent, or Firm*—William A. Drucker

[57] ABSTRACT

A cover including switching chambers and housing contact carriers is associated with a base supporting two slides which act by the intermediary of frames either directly on the contacts, or through the intermediary of springs.

4 Claims, 4 Drawing Figures

SWITCH OPERATING DEVICE

BACKGROUND OF THE INVENTION

The invention relates to an apparatus for the forcible opening of two switches, in particular limit switches, with the aid of a single control means acting, through the intermediary of actuating ramps, on two movable members passing to a dead point, and on the other hand directly on contact carriers appertaining respectively to each switch.

THE PRIOR ART

The apparatuses of the prior art corresponding to the construction defined above generally involve the association of two switches with separate forced opening, of each switch. The relating one to the other of the respective instants when opening ought to occur necessitates separate adjustments which must both be re-set in the case of de-adjustment of one of them; furthermore, these switches are most often provided for the interruption of relatively small control currents. When two such switches are disposed in a same housing, as is found in the apparatus known as selectors, their control by a movable member having a large stroke necessitates the incorporation in the housing of stroke-reducing means, which necessitates a very large volume.

OBJECT OF THE INVENTION

The object of the invention is accordingly to provide a compact apparatus, capable of carrying out the functions already obtained in the prior art by other ways, in which the switching operations to be obtained can be made in higher power circuits, and wherein steps are taken to improve the simplicity of its construction and of its operation.

SUMMARY OF THE INVENTION

According to the invention, this result is obtained in that the apparatus comprises a housing formed by placing together:

(i) a cover which contains parallel switching chambers placed side by side, said chambers respectively receiving guiding means necessary for the abrupt displacement in its particular direction of one of two contact carriers each provided with a pusher member and associated with stationary contacts, and (ii) a base in which are disposed a common control means and two movable slides each carrying actuating ramps, these two movable slides being urged back one towards the other by resilient means, and a frame resiliently associated with each pusher member and surrounding the same and resilient means, being placed between each slide member and the corresponding pusher member.

BRIEF DESCRIPTION OF THE DRAWINGS

Other features and advantages of the invention will be apparent from the following description, with reference to the accompanying drawings, wherein.

The end-of-stroke switch apparatus has a housing 1 comprising a cover 2 joining to a base 3 along a plane of connection ZZ'.

This base will preferably serve for the fixing of the apparatus on a support.

Figures 1, 1A, 2:
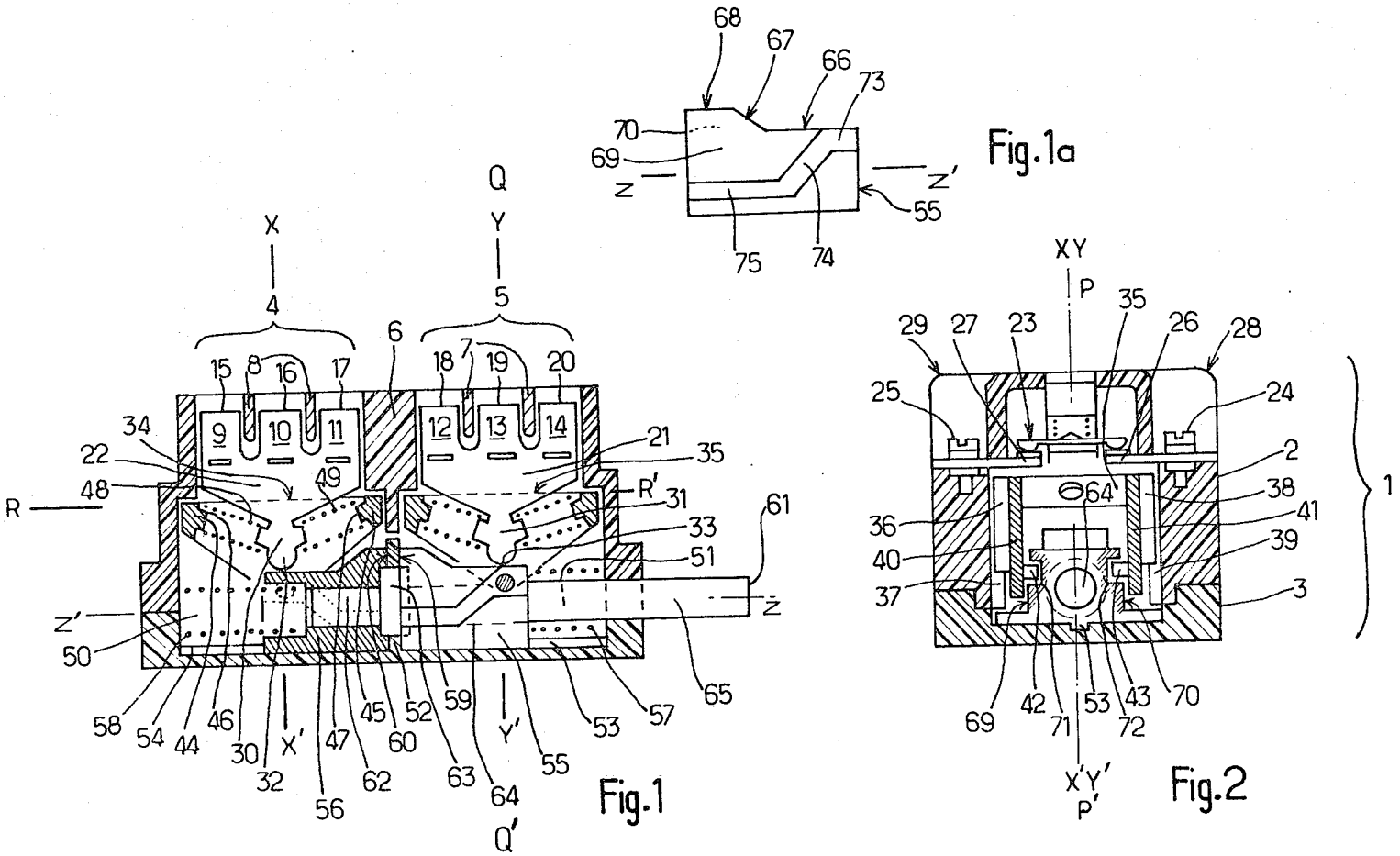
FIG. 1 is a sectional elevation of the apparatus taken on a plane of symmetry PP' in FIG. 2.
FIG. 1*a* shows details of a movable member carrying ramps.
FIG. 2 is a sectional elevation taken on the plane QQ' in FIG. 1.

The cover 2 seen in FIG. 1 comprises two separate switch chambers 4 and 5 placed side by side, and separated by a massive wall 6. Each chamber contains parallel partitions 7 and 8 serving to isolate the switching zones 9, 10, 11 and 12, 13, 14 respectively, in which there move the parallel arms 15, 16, 17 and 18, 19, 20 respectively appertaining to two separate rack-like members 21, 22 carrying contact bridges (see FIG. 2). Terminals 24, 25 coupled to respective fixed contacts 26 and 27 cooperating with the bridge, terminate at respective upper surfaces 28 and 29 of the cover, also seen in FIG. 3.

Figure 3:
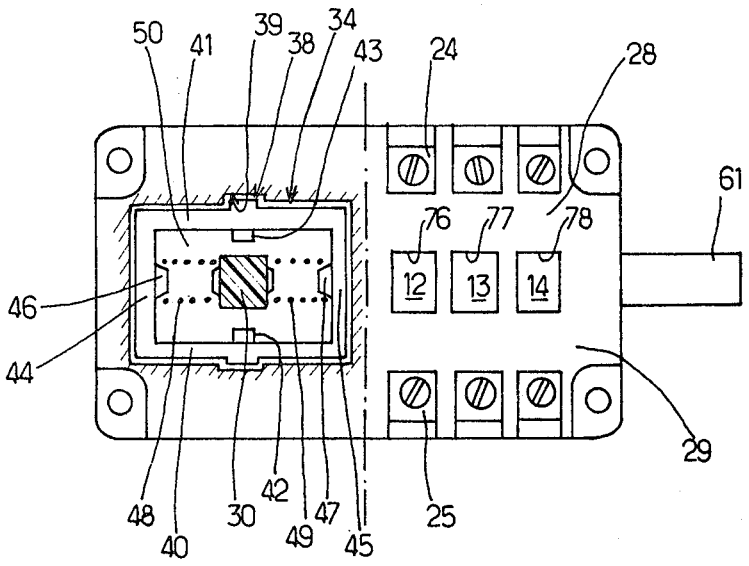
FIG. 3 is a plan view of the apparatus, partially sectioned along the plane RR' in FIG. 1.

Each rack-like member 21, 22 is extended, at the edge remote from the contacts, by a respective pusher member 30, 31 terminated by a respective bearing surface 32, 33. These rack-like members 21, 22 are guided in the respective chambers 5, 4 by openings (76, 77, 78, FIG. 3) receiving the arms 18, 19, 20. Two frames 34, 35, of which one is visible in FIG. 3, respectively surround each rack-like member 21, 22 at least in the region of the pusher members 30, 31, and can move parallel to the rack-like members 21, 22 by reason of guiding ribs and grooves 36, 37 and 38, 39 (FIGS. 2 and 3). Each of these frames 34, 35 which in the example illustrated have the shape of a hollow body having a rectangular base comprises two opposed triangular walls 40, 41 carrying laterally the above-mentioned ribs, and two fingers 42, 43 placed transversely with respect to the respective directions of movement XX' and YY'.

Two other opposed rectangular walls 44, 45, perpendicular to the walls 40, 41, carry, on their surfaces facing towards the corresponding pusher member, engagement means 46, 47 receiving the respective first ends of two compression springs 48 and 49, the second end of each such spring bearing under compression on the respective pusher member 30, 31.

In the working position of these frames illustrated in FIG. 1, the resilient force of the springs exerted on the pusher members 30, 31 has caused the displacement towards the bottom of the drawing of the rack-like members 21, 22 and the contacts are closed.

In a modification which will be obvious to those skilled in the art, the contacts could equally well be open in this position of the rack-like members. The base 3 comprises two separate chambers 50, 51 separated by a common partition 52 placed substantially opposite to the wall 6, each chamber 50, 51 being provided with a respective guiding surface 53, 54 perpendicular to the planes XX' and YY', and to the partition 52.

These chambers 50, 51 each receive a movable slide 55, 56 guided by the respective surface 53, 54 and each urged by a respective one of two compression springs 57, 58 onto opposed faces 59, 60 of the partition 52, see FIGS. 1 and 2.

It would likewise be possible to use a common traction spring (not shown) urging the two movable slides 55, 56 one towards the other.

As can be seen particularly in FIG. 1, wherein the left hand slide 56 has been partially sectioned, a common control member 61 is movable along the axis ZZ' and passes across the two slides parallel to the guide surfaces and comprises four successive portions; a first portion 62 disposed at the interior of the movable slide 56, a collar 63 placed substantially in the plane of the partition 52 which it passes through an aperture 80, a third portion 64 disposed at the interior of the movable slide 55, and a fourth portion 65 extending from the base in order to permit its actuation by an external means.

In the rest position illustrated in FIG. 1, the control member 61, as a result of the opposed forces provided by the springs 57, 58 through the movable slides on the collar 63, occupies a central position from which it can move away towards the right or towards the left. In a first movement, the collar 63 will cause the displacement towards the right of the slide 55 against the spring 57, and in an inverse movement will cause the displacement towards the left of the slide 56 against the spring 58.

The slide 55, which is identical to the slide 56, see FIG. 1*a*, comprises at an edge remote from the guiding surface 54 three successive control surfaces; a first plane surface 66 parallel to plane ZZ', followed by a ramp 67 which is inclined, and a second plane surface 68 parallel to plane ZZ' placed at a level above the first plane surface 66.

On two opposed lateral faces 69, 70 parallel to the plane PP' and visible also in FIG. 2, the slide 55 has two grooves 71, 72 having a same profile and formed by a first region 73 parallel to plane ZZ', a second region 74 inclined in reverse direction to the surface 67, and a third region 75 parallel to the first region and placed below the latter.

The fingers 42, 43 of the frames 34, 35 enter into the interior of these grooves, whilst the bearing surfaces 32, 33 of the rack-like members 21, 22 bear on the control surfaces 66, 67, 68.

During a displacement of the control member 61, the grooves moved along with the corresponding slide cause a displacement of the corresponding frame 34, 35, upwardly or downwardly, which causes compression of the springs 48, 49 and produces, immediately after their maximum compression at dead centre point, an abrupt displacement of the corresponding rack-like member 21, 22 upwardly or downwardly.

Nevertheless, if welded contacts or any other chance happening prevents the rack-like member from moving under the effects of the resilient force exerted, the action of the control surfaces on the bearing surfaces becomes substituted for this resilient force and ensures a forced mechanical separation of the contacts.

The advantageous manner of construction of the invention described herein could be the subject of obvious variations for the man skilled in the art without exceeding its scope.

Thus, although the cover and the base are shown as joining at the plane of division ZZ' which permits a simplified placing in position of the common control member 65, and the resilient means creating the dead centre point, and also the frames, are all placed in the cover, it would likewise to possible to have the base of greater height and to limit the height of the cover by making these items meet, for example, at the level of the plane RR'; the frames 34, 35 would in this case be guided in the base.

I claim:

1. A switch operating device comprising:

(i) a housing including:

(a) a cover portion having first and second parallel switching chambers placed side by side (b) a base portion having first and second further chambers (ii) first and second contact carriers movable in a first direction within the respective first and second switching chambers, and first and second pusher members integrally mounted on the first and second contact carriers and extending into the base portion, respectively (iii) first and second frames respectively surrounding the first and second pusher members within the base portion and movable in said first direction (iv) first and second resilient means respectively connecting the first and second pusher members to the first and second frames, said first and second resilient means respectively creating a dead center point for the first and second frames, respectively;

(v) first and second slides movable in a second direction at right angles with the said first direction within said first and second further chambers, each of said slides having first actuating ramps which cooperate with the respective pusher member and second actuating ramps cooperating with the respective frame;

(vi) first and second further resilient means respectively mounted in the first and second further chambers for normally urging the respective first and second slides one towards the other along said second direction, and (vii) an elongated control member respectively movable within the base portion along the said second direction, said control member having means for driving the first and second slides in opposite senses away from each other, said control members having an extension located outside the housing.

2. A switch operating device as claimed in claim 1, wherein the driving means of said control member consist of a collar located between the first and second slides and cooperating with the said slides, said collar normally assuming a rest position when no external force is exerted on said extension of the control member.

3. A switch operating device as claimed in claim 2, wherein each frame is shaped as a hollow body having first and second opposed walls substantially at right angles with the said second direction and third and fourth opposed walls substantially at right angles with the first and second walls, the first and second resilient means engaging the said first and second walls of the respective frame and first and second fingers, carried by the respective third and second walls and substantially perpendicular thereto, said fingers cooperating with the said second actuating ramps.

4. A switch operating device as claimed in claim 3, wherein each of said first actuating ramps comprises first and second plane surface portions parallel to the said second direction and an inclined ramp surface portion connecting the said first and second plane surface portions and each of said second actuating ramps comprises first and second grooves, each having first and second regions parallel to the said second direction and a third inclined region connecting the first and second regions.

* * * * *